US006230925B1

(12) United States Patent
Hardigg et al.

(10) Patent No.: US 6,230,925 B1
(45) Date of Patent: May 15, 2001

(54) LIGHTWEIGHT HANDLE

(75) Inventors: James S. Hardigg, Conway; Rene R. Aponte, Chicopee, both of MA (US); Robert L. Wells, Jr., Thetford Center, VT (US)

(73) Assignee: Hardigg Industries, Inc., S. Deerfield, MA (US)

( * ) Notice: Subject to any disclaimer, the term of this patent is extended or adjusted under 35 U.S.C. 154(b) by 0 days.

(21) Appl. No.: 09/229,016

(22) Filed: Jan. 12, 1999

Related U.S. Application Data

(60) Provisional application No. 60/071,448, filed on Jan. 13, 1998.

(51) Int. Cl.[7] ..... B65D 25/28

(52) U.S. Cl. ..... 220/761; 220/762; 220/767; 220/764

(58) Field of Search ..... 220/761, 753, 220/762, 763, 764

(56) References Cited

U.S. PATENT DOCUMENTS

| | | | |
|---|---|---|---|
| 337,889 | 3/1886 | Taylor . | |
| 630,886 | 8/1899 | Held . | |
| 644,119 | 2/1900 | Witt . | |
| 747,570 | 12/1903 | Pickop . | |
| 908,285 | 12/1908 | Lewis . | |
| 1,940,099 | 12/1933 | Preston | 16/189 |
| 2,088,476 | 7/1937 | Kemper . | |
| 2,254,506 | 9/1941 | Wheary, Jr. | 16/126 |
| 2,401,399 | 6/1946 | Akers | 16/114 |
| 2,436,598 | 2/1948 | Pastor et al. | 16/112 |
| 2,517,369 | 8/1950 | Wolfson | 190/57 |
| 2,767,424 | 10/1956 | Knuepfer | 16/126 |
| 3,248,750 | 5/1966 | Black | 16/126 |
| 3,464,586 | 9/1969 | Hitzeroth | 220/94 |
| 3,538,538 | 11/1970 | Field | 16/189 |
| 3,562,849 | 2/1971 | Brayshaw | 16/126 |
| 3,699,611 | 10/1972 | Johnson | 16/114 |
| 3,804,290 | 4/1974 | Billman | 220/72 |
| 3,813,729 | 6/1974 | Szabo et al. | 16/119 |
| 3,924,775 | 12/1975 | Andreaggi et al. | 220/96 |
| 4,157,763 * | 6/1979 | Betlejenski et al. | 220/761 |
| 4,196,821 | 4/1980 | Teti, Jr. et al. | 220/94 |
| 4,223,421 | 9/1980 | Wassenaar | 16/172 |
| 4,284,202 | 8/1981 | Barstow, Jr. | 220/4 |
| 4,475,415 | 10/1984 | Yamamoto | 74/543 |
| 4,544,050 | 10/1985 | Seynhaeve | 190/115 |
| 5,012,553 | 5/1991 | Hardigg et al. | 16/126 |
| 5,226,553 | 7/1993 | Fiore | 220/318 |
| 5,461,755 | 10/1995 | Hardigg et al. | 16/112 |

* cited by examiner

*Primary Examiner*—Joseph M. Moy
(74) *Attorney, Agent, or Firm*—McCormick, Paulding & Huber LLP

(57) ABSTRACT

Disclosed is a light weight handle assembly adapted to transport a heavy duty container which may contain sensitive electronic components. The handle assembly of the present invention generally comprises a stationary bracket which mounts to a container wall and a movable handle pivotally connected to the bracket. The bracket is formed with an inner portion that is adapted to rotatably engage with a pair of pivoting arms extending from the movable handle so that the light weight handle may easily be assembled and disassembled. Each of the pivoting arms is formed with a movable stop member which is advantageously positioned to contact and bear against stationary stop members which are attached to or are a part of the container to which the handle is attached. The stationary stop members and movable stop members each have a substantially planar contact surface which is designed such that when the movable handle is pivoted to the lifting/operative position, the movable stop members are in contact with the at least one stationary stop member with less stress in the materials than in conventional handles. The lower stresses enable a strong handle to be made of plastic material such as polyethylene.

21 Claims, 6 Drawing Sheets

LIGHTWEIGHT HANDLE

CROSS REFERENCE TO RELATED APPLICATIONS

This application claims the benefit of an earlier filing date from U.S. Provisional Application Ser. No. 60/071,448, filed Jan. 13, 1998.

BACKGROUND OF THE INVENTION

1. Field of the Invention

The invention relates to handles. More particularly, the invention relates to handles fastenable to a container and which provide a lightweight, yet strong and stable platform for carrying the container.

2. Prior Art

Handles of one kind or another have been manufactured and used for as long as there have been things to carry. In particular, container handles have experienced significant advances in design and manufacture over the years to provide hidden handles, handles that are maintained away from the container wall, handles which lock in various positions and spring loaded handles. While all of these handles are useful for their intended purposes, they have drawbacks of one kind or another such as excessive weight, excessive size, excessive expense and unacceptable generation of forces in particular areas which may not be desirable. One prior art handle provides significant reduction of stresses in the handle allowing lighter, less expensive materials to be used. This has been a great benefit to the art. Unfortunately, U.S. Pat. No. 5,461,755 is relatively large and can only be employed on larger containers. This is due in part to the size of the stationary bracket that holds the handle to the container. Reducing the size of the bracket and reconfiguring its function is the subject of this disclosure.

SUMMARY OF THE INVENTION

The above-discussed and other drawbacks and deficiencies of the prior art are overcome or alleviated by the lightweight stress reducing handle of the invention.

The handle of the invention is an extremely lightweight handle having a pre-engineered stress reducing construction in combination with handle stop capability which depends upon a feature of the container to which the handle is mounted while maintaining contact zones in stress reduced angles. The handle is even more lightweight and compact than the prior art and advantageously can be mounted on a small container as well as a large container. More particularly, the handle of the invention comprises a stationary bracket portion mountable to a wall of a container adjacent a portion of the container which provides a stop surface upon which the handle portion, pivotally mounted in said stationary bracket, may bear. The handle is engineered such that the contact plane between stop surfaces on the handle portion and the portion of the container acting as a stop surface will be approximately 45° to the mounting surface of the stationary bracket. Providing a cooperating surface designed to contact a feature of a container at a particular preset angle of about 45° significantly reduces stress in the handle and provides for substantially more longevity in the handle. Moreover, the reduced stress in the handle allows the use of cheaper, lighter and less structurally strong materials. Employing the 45° contact surface removes concern regarding the material of the container as well since the force acting thereon is significantly lower than it might otherwise be.

The handle of the invention is most preferably spring loaded and easily disassembled from a stationary bracket once such bracket is not attached to the container.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
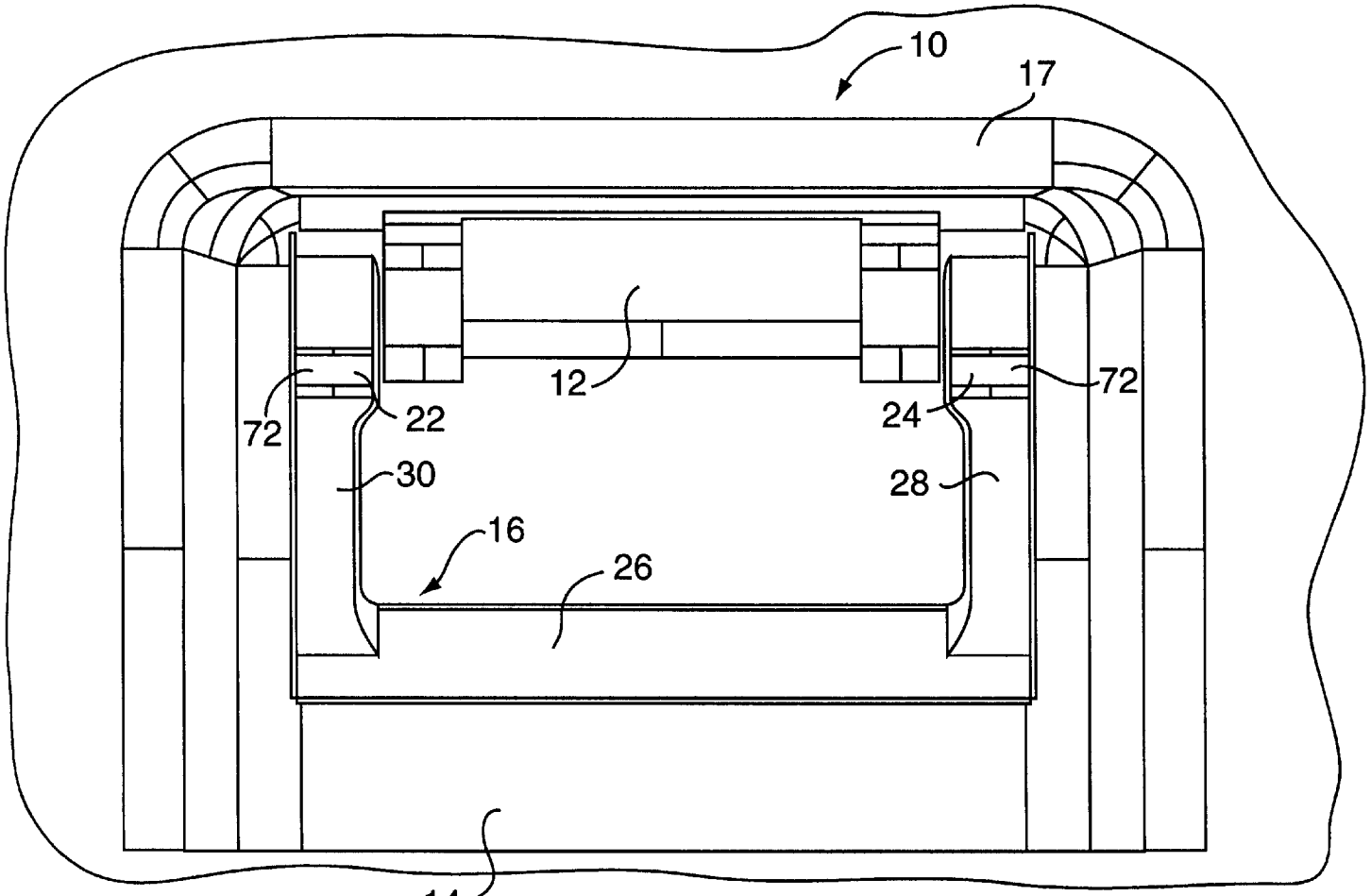
FIG. 1 is a front plan view of the handle of the invention mounted on a section of container wall.
Figure 2:
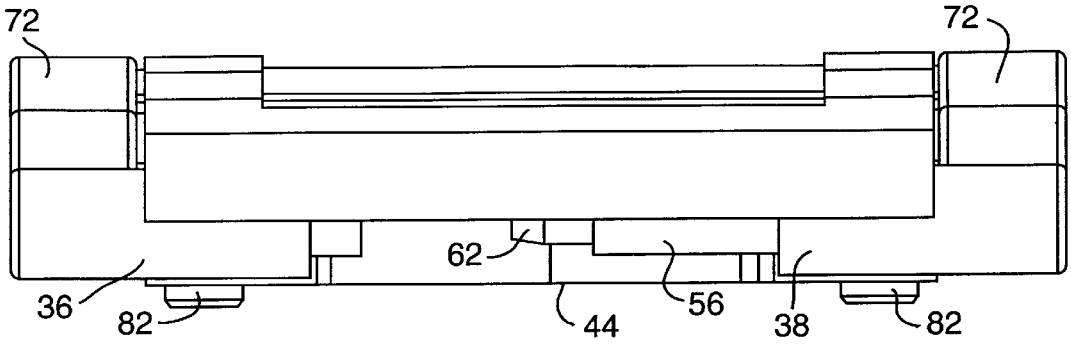
FIG. 2 is a top plan view of the handle of the invention.
Figure 3:
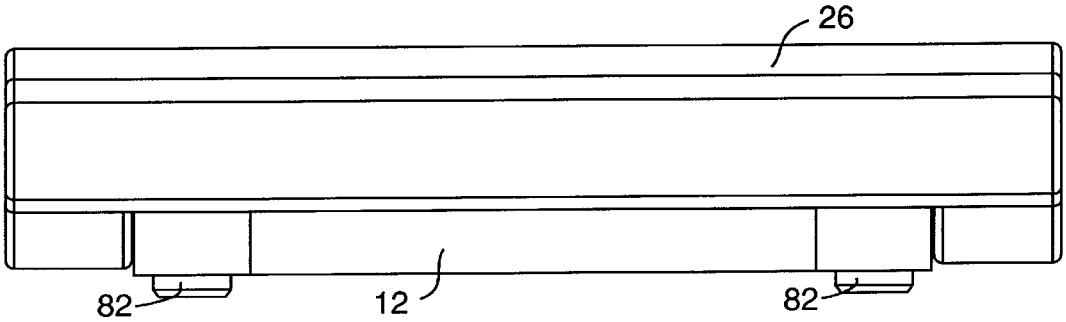
FIG. 3 is a bottom plan view of the handle of the invention.
Figure 6:
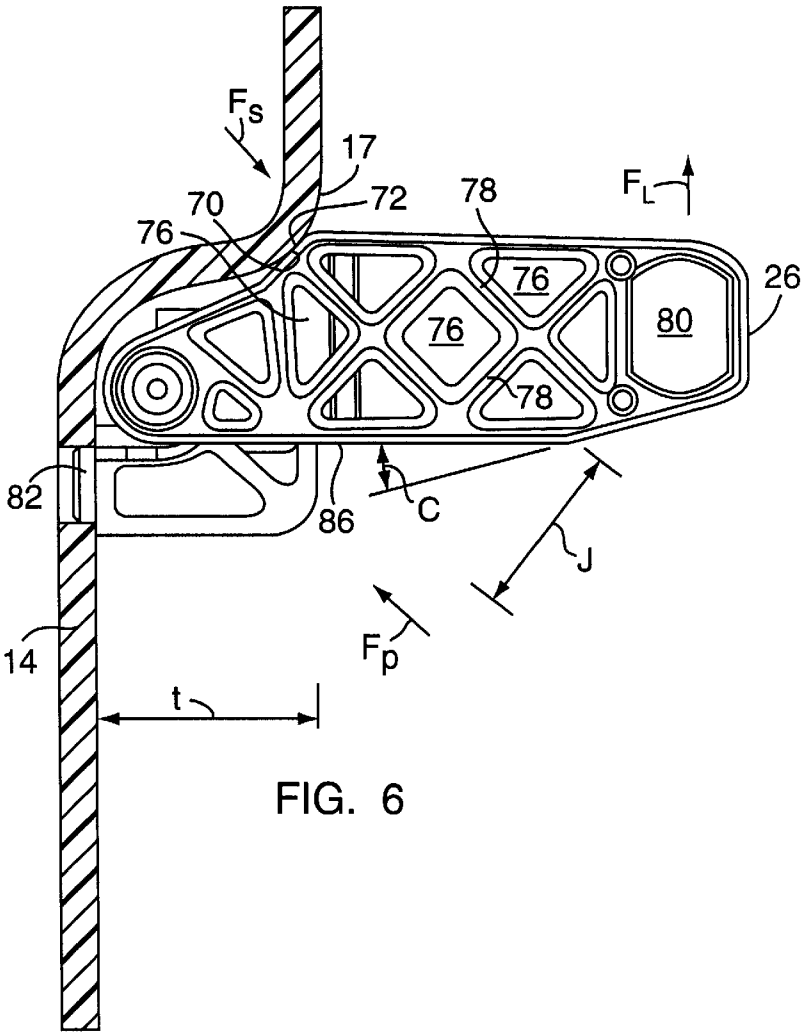
FIG. 6 is a side view in the operative position.
Figure 5:
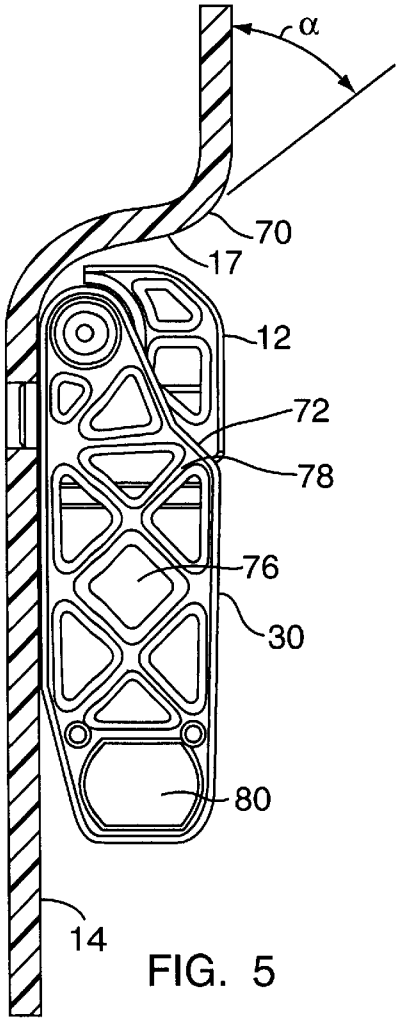
FIG. 5 is a side view of the handle of the invention in the inoperative position.

Referring to FIG. 1, the light weight handle assembly according to the present invention is illustrated. The handle assembly 10 generally comprises a stationary bracket 12 mounted to a container wall 14 which may be a wall of a roto-molded container or any other container. The handle assembly 10 further comprises a movable handle 16 which is pivotally connected to the stationary bracket 12. When the stationary bracket 12 is connected to the container wall 14, the movable handle 16 may be pivoted between an inoperative position (FIG. 5) and an operative position (FIG. 6). When the stationary bracket 12 is not attached to or is removed from the container wall 14, the movable handle 16 may be easily removed from bracket 12. Easy removal is facilitated by bracket 12 merely trapping a portion of handle 16 (disclosed hereunder) to container wall 14. This feature of the present invention allows the handle assembly 10 to be quickly assembled or disassembled, thereby increasing production efficiency and reducing repair time, respectively.

To stabilize the handle assembly 10 while the container is being carried by the handle, there is provided at least one stationary stop member. Handle 16 also provides two moveable stop members located advantageously on pivoting arms (further discussed hereunder) which are to contact another structure (or structures). In the preferred embodiment this is a part of the container termed protuberance 17. The movable stop members 22 and 24 and the protuberance 17 are adapted to contact each other to thereby limit the pivotal movement of the movable handle 16 between its inoperative position (FIG. 5) and its operative position (FIG. 6). As will be described more fully herein, the protuberance 17 and the movable stop members 22 and 24 contact one another at about 45° to container wall 14. This reduces the stress in the handle allowing less expensive materials to be used.

Figure 4:
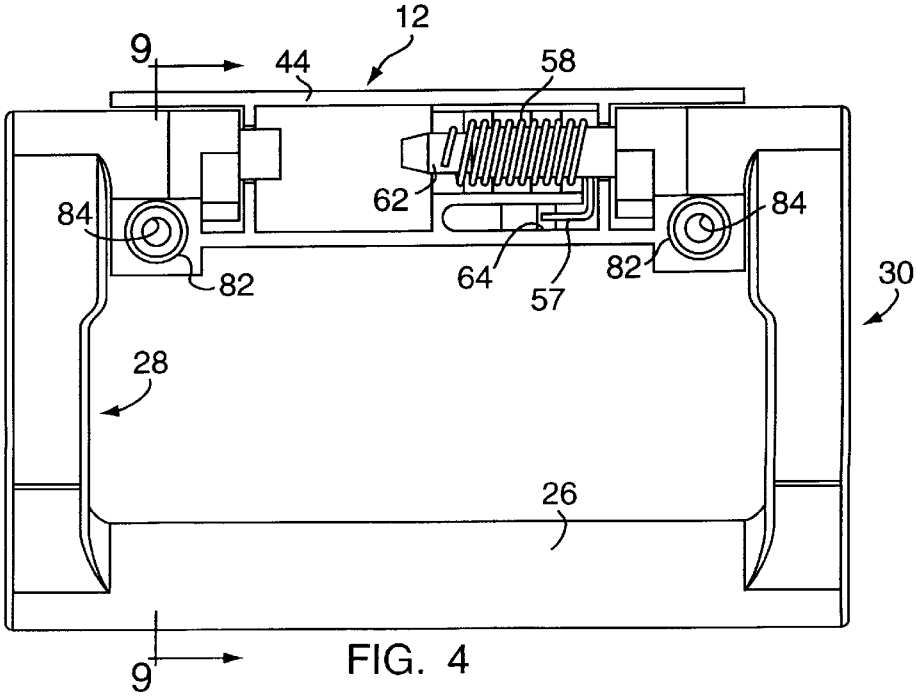
FIG. 4 is a rear plan view of the handle of the invention.
Figure 7:
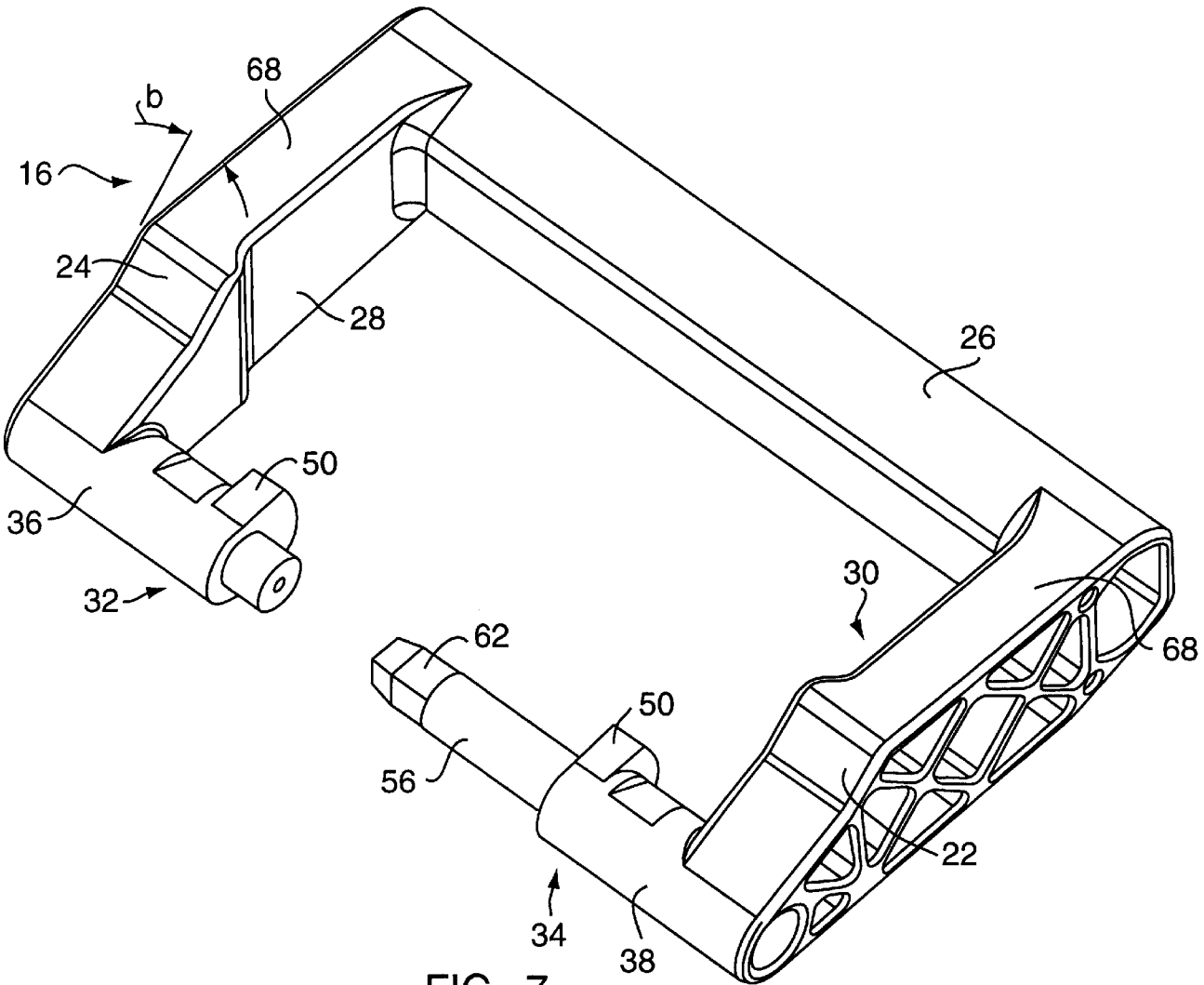
FIG. 7 is a perspective view of the bail of the invention separated from the bracket.

Referring to FIGS. 1, 4 and 7, the movable handle 16 comprises a hand grip 26 adapted to be comfortably grasped by a user's hand. The movable handle 16 further comprises a pair of pivoting arms 28 and 30 that extend from the hand grip 26 and which are generally parallel to each other. The movable handle 16 further comprises rotating pivot portions 32 and 34 which extend from the distal end of the pivoting arms 28 and 30, respectively and which are generally disposed parallel to the hand grip 26.

Figure 8:
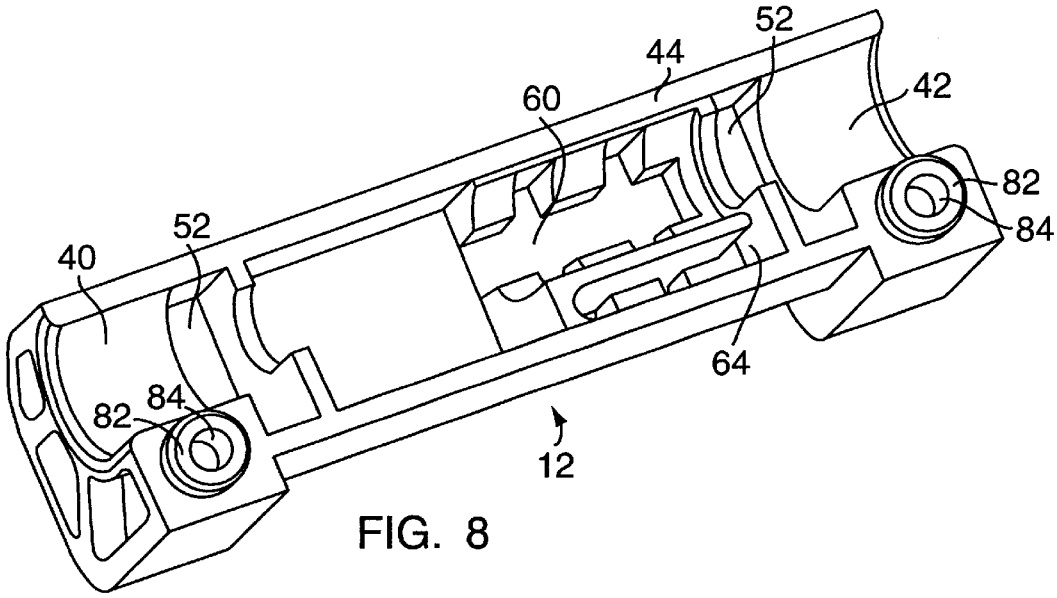
FIG. 8 is a perspective view of the bracket of the invention separated from the bail.
Figure 9:
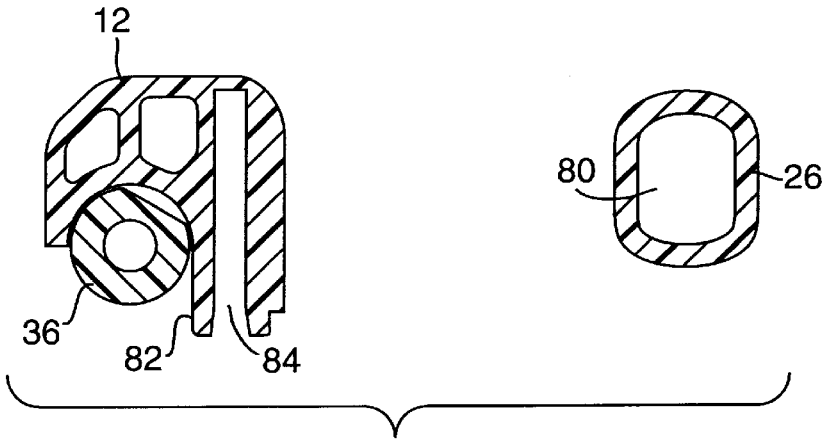
FIG. 9 is a cross-section view of the invention taken along section line 9—9 in FIG. 4.

With reference to FIG. 7, the rotating pivot portions 32 and 34 comprise cylindrical portions 36 and 38, respectively, which are adapted to freely rotate within corresponding cylindrically shaped cavity portions 40 and 42 (FIG. 8) extending inwardly from a rear surface 44 of the stationary bracket 12. Cylindrical portions 36 and 38 are captured within the first and second cavity portions 40 and 42 when bracket 12 is fastened to container wall 14. When the movable handle 16 is in its operative position (FIG. 6), the cylindrical portions 36 and 38 are in bearing contact with their corresponding cavity portions 40 and 42.

Still referring to FIG. 7, each of the rotating pivot portions 32 and 34 further comprise a semi-circularly shaped flange portion 50 protruding from respective ends of the cylindrical portions 36 and 38 which are adapted to freely rotate within corresponding cylindrically shaped cavity portions 52 which extend inwardly from the rear surface 44 of the stationary bracket 12. When the flange portions 50 are disposed within the cavity portions 52, the axial movement of the cylindrical portions 36 and 38 and therefore the handle is limited.

Figure 11:
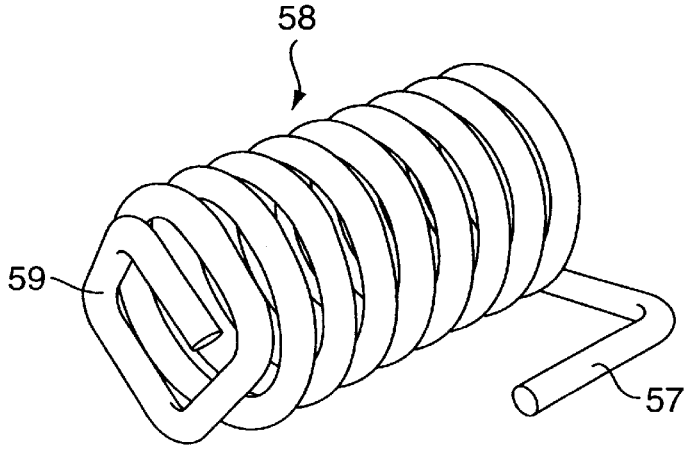
FIG. 11 is a perspective view of the torsion spring of the invention.
Figure 10:
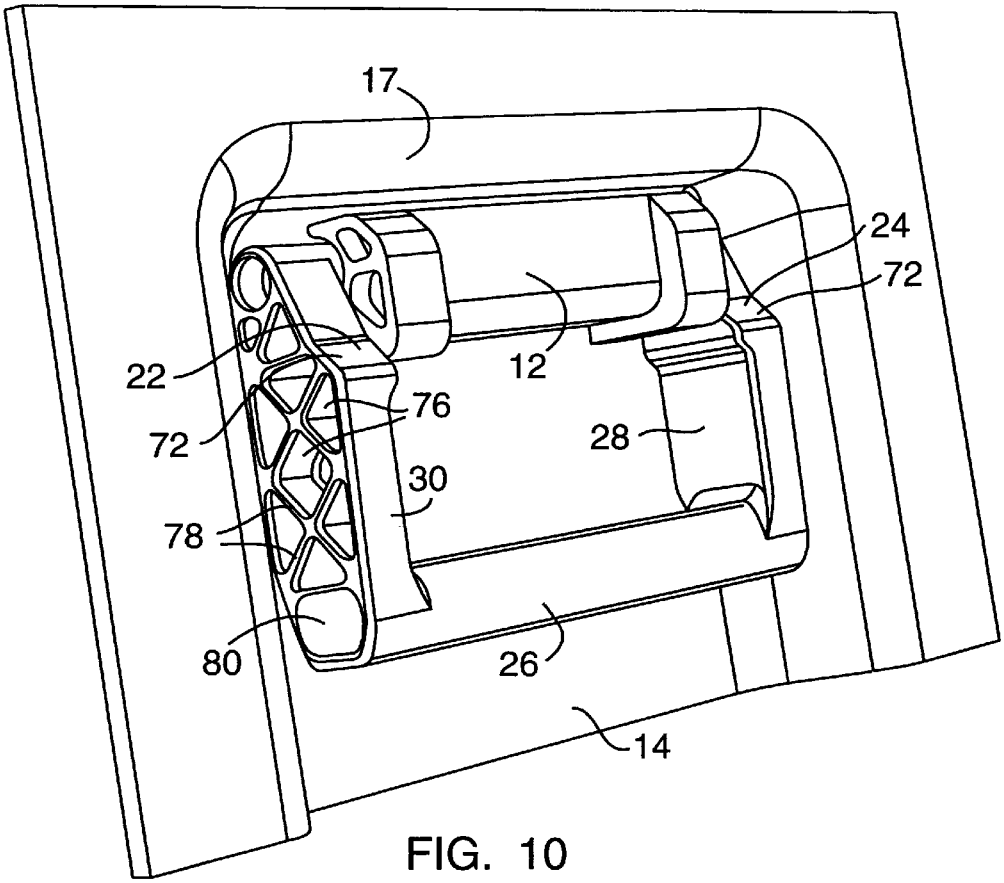
FIG. 10 is a perspective view of the handle of the invention attached to a section of container wall.

The rotating pivot portion 34 further comprises a spring support 56 disposed adjacent to and extending from the cylindrical portion 38. The spring support portion 56 is of generally cylindrical shape and is adapted to receive a torsion spring 58 (FIG. 4). The spring support portion 56 is rotatable within a spring attachment cavity 60 extending inward from the rear surface 44 of the stationary bracket 12. The spring support 56 further includes a rounded square section 62 that is adapted to secure one end of the torsion spring 58 which has been wound around a square mandrel to produce square spring tang 59. The spring configuration is illustrated in FIG. 11. The spring and spring support 56 have been selected to reduce stress in the parts thereby creating a longer lifespan for those parts. Where prior art torsion springs have been engaged in a slot in the part around which they are disposed the slotted material tends to fracture from use. Since the square section 62 is inherently of a thicker cross section, it is better able to handle the stress. The stress is also divided over four corners as opposed to two as in the stated prior art arrangements. The other end of the torsion spring 58 is secured by spring leg 57 receivable within a channel 64 formed adjacent to the cavity 60. The at least one stationary stop member is preferably protuberance 17 illustrated in FIGS. 5 and 6; alternatives being protrusions of the molded container located differently and separate structures mounted to the container wall at a predetermined location relative to the light weight handle. In each of the possible alternates the paramount point is that for the construction dictated the contact orientation for the moveable stop members is about 45° to the container wall/mounting surface of the handle of the invention when the handle is in the operative position. The movable stop members 22 and 24 are formed on an outside portion 68 of the pivoting arms 28 and 30. In a preferred embodiment, the at least one stationary stop member supplies a contact surface 70 that is at an angle $\alpha$ to the bracket 12 and container wall 14. In the preferred embodiment, the angle $\alpha$ is about 45 degrees. Similarly, the movable stop members 22 and 24 are each formed with a substantially planar contact surface 72 which is off-set an angle b from outside surface 68 of the pivoting arms 28 and 30. In a preferred embodiment, the angle b is about 45 degrees. In operation, when the movable handle 16 is pivoted from its inoperative/stored position (FIG. 5) to is operative/lifting position (FIG. 6), the movable stop members 22 and 24 are brought into substantial contact with the stationary stop member 17. As such, the pivotal movement of the movable handle 16 between its inoperative position (FIG. 5) and its operative position (FIG. 6) is about 90 degrees. The contact surfaces 70 and 72 meet at an angle of about 45° to the plane of container wall 14. This is beneficial because it reduces shear stress in the handle and allows the use of softer less expensive materials.

Referring to FIGS. 2, 4, 5 and 6, the stationary bracket 12 also comprises a plurality of mounting lugs or bosses 82 disposed on the rear surface 44 of bracket 12. In the preferred embodiment, the mounting lugs or bosses 82 extend from the rear surface 44 and provide shear strength between the bracket 12 and the container wall 14. In this regard, the hand gripping portion 26 of the movable handle 16 may be upwardly displaced an angle c from a bottom surface 86 of the pivoting arms 28 and 30 to thereby facilitate initial grasping of the hand gripping portion 26. In the preferred embodiment the angle c is in the range of about 15°–25° and preferably is about 19°. The mounting lugs 82 may further comprise openings 84 adapted to receive a suitable fastener such as a self-tapping screw and the like. Such fasteners are loaded in tension only, and sealing against air passage is accomplished by the employment of rubber-faced washers under the heads of the fasteners.

The stress-lowering improvements of the handle of the present invention may best be demonstrated with reference to FIG. 6. As shown, the handle 16 is placed in its operative/lifting position by an upward force $F_L$ applied to the hand grip 26. As said handle 16 has two pivoting arms 28 and 30, the upward force on each arm 28 and 30 is $F_L/2$. Upward rotation beyond 90° is prevented by a compressive stop force $F_s$ in the contact area between the movable stop members 22, 24 and stationary stop member 17 and a shear force in the pivot $F_p$. For a specific magnitude of $F_L$, the stop force $F_s$ is inversely proportional to the moment arm J. Thus, to minimize $F_s$, the moment arm J must be as large as possible. This is controlled by the thickness t of the bracket 12 and the diameter of the pivot portions 32 and 34. When the thickness of the bracket 12 and the handle 16 are approximately the same, the moment arm J will be maximized when the angle of the plane between the axis of the pivot portions 32 and 34 and the stop areas 18, 20, 22 and 24 is 45° relative to the horizontal. In the preferred embodiment where said angle is 45°, said moment arm J is approximately 1.5 times greater than when contact between the movable stop members and stationary stop member is horizontal. Thus, for the same lifting force $F_L$, the compressive stress in the stop member area of the handle 16 is approximately 33% less. This stress-lowering improvement in the handle 16 makes it possible to produce said handle from polyethylene and other low-cost materials such as polypropylene and acrylonitrile-butadiene-styrene (ABS). Polyethylene is preferred due to its nearly inert properties.

Figure 12:
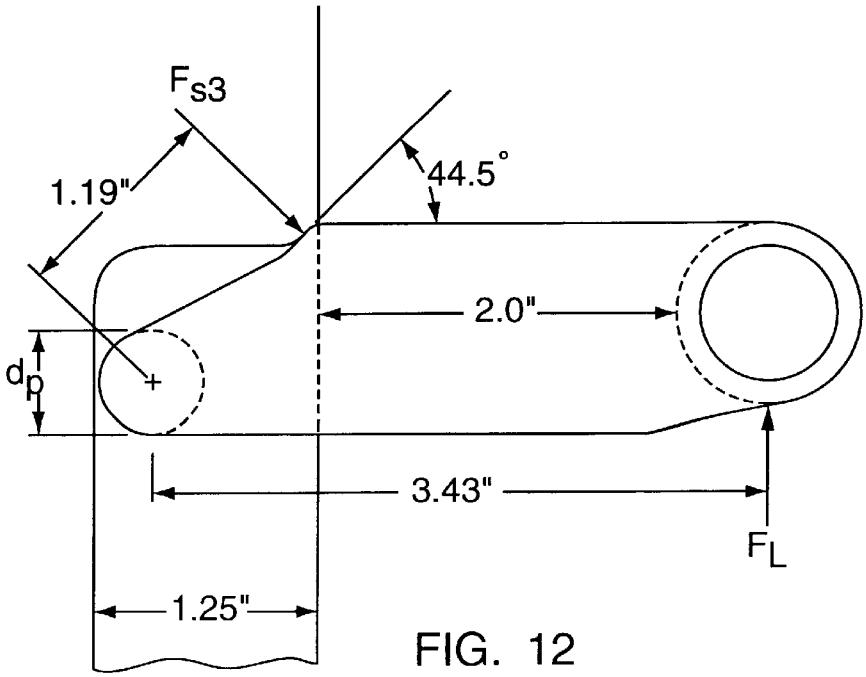
FIG. 12 is a side elevation view of the handle of the invention in the raised position which includes exemplary measurements and force vectors for one particular example of the invention.

As will be clear to those skilled in the art, a change in the ratio of bracket thickness to handle thickness will dictate a change in the angle for maximizing the moment arm J. It will also be understood that although the preferred angle of 45° for the construction dictated is optimum, departures from this angle reduce efficiency in increments. Thus, as long as the angle selected is near 45°, a substantial amount of the benefit of the invention will be retained. Preferably, the range of angles for the contact surfaces should be about 38° to about 52° to the container wall with a more preferred range of about 42° to about 48°. It will be understood by one of ordinary skill in the art, subsequent to exposure to this disclosure, that the force advantage of the present invention deteriorates in each direction of angle when moving away from the optimum of about 45°. Referring to FIG. 12, one example of the invention is provided with measurements taken and forces shown. The calculations set forth hereunder demonstrate the very low pivot and stop forces associated with the handle of the invention. The formulae are intended to be read in conjunction with FIG. 12:

$$F_L\,3.43 = F_{s3}\,1.19 \qquad \cos 44.5° = 0.713$$

$$F_s = 2.88F_L \qquad \sin 44.5° = 0.701$$

$$F_P = \sqrt{(F_{PH3})^2 + (F_{PV3})^2}$$

$$F_{PH3} = F_{s3}\cos 44.5° = 2.88\,F_L\,0.713 = 2.05\,F_L$$

$$P_{PH3} + F_L = F_{S3}\sin^{\theta}$$

$$P_{VH3} = F_{S3}\sin 44.5° - F_L = 2.88\,F_L\,0.701 - F_L = 2.01F_L - F_L - F_L = 1.01F_L$$

$$F_P = \sqrt{(2.05F_L)^2 + (1.01F_L)^2} = F_L\sqrt{4.20 + 1.02} = 2.28\,F_L$$

The stationary bracket 12 and the movable handle 16 may be made from a variety of materials, including but not limited to, polyethylene or any high strength thermoplastic material. The handles of the invention uniquely may be made of polyethylene which if used in a configuration not adhering to the parameters of the invention is generally not structurally strong enough to act as a functional handle. To realize additional weight reductions and to reduce material costs and molding time, material from the stationary bracket 12 and the movable handle 16 may be removed in various places without significantly reducing the load/strength requirements of the components. By way of example only, the pivoting arms 28 and 30 may be formed with cut-outs 76 (FIG. 5) which eliminate a large amount of material and ribs 78 may be formed to maintain the strength requirements. Similarly, the hand grip 26 may be formed with a hollow inner portion 80 thereby also removing a significant amount of material.

Except for the torsion spring 58, protuberance on the container and mounting bolts (not shown), all of features of the handle assembly 10 heretofore described are formed integral to either the stationary bracket 12 or the movable handle 16. (Stationary stop members other than those molded as part of the container are additional structures). This feature provides a handle assembly 10 that is compatible with high production environments and which is reliable and durable. The stationary bracket 12 and the movable handle 16 may be manufactured by conventional molding processes suitable for use with thermoplastic materials.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A handle assembly disposed on a container wall for lifting and transporting said container, the handle assembly comprising:

a stationary bracket affixed to the container wall, said bracket having an inner and outer portions;

a movable handle comprising a hand grip and first and second arms extending from said handgrip, each of said first and second arms including an outer portion and a pivot portion substantially parallel to said hand grip, each of said pivot portions being rotatable within said inner portion of said inner bracket so that said movable handle may be pivoted between a first position and a second position;

a spring support extending axially from said pivot portion of said first arm, said spring support having a substantially square section disposed on a distal end thereof; and a coiled torsion spring disposed about said spring support having a first end and a second end, said first end being formed as a substantially square tang for mating engagement with an outer periphery of said substantially square section, and said second end being attached to said stationary bracket.

2. The handle assembly of claim 1, wherein said inner portion of said stationary bracket includes first and second retainers for retaining said first and second pivot portions of said movable handle.

3. The handle assembly of claim 1, wherein each of said pivot portions of said movable handle further includes a cylindrical portion adapted to rotate within said inner portion of said stationary bracket.

4. The handle assembly of claim 3, wherein each of said pivot portions of said movable handle further include a flange portion extending outwardly from said cylindrical portion so as to limit the axial movement of said pivot portion within said inner portion of said stationary bracket.

5. The handle assembly of claim 4, wherein said inner portion of said stationary bracket comprises a first cavity for rotatably receiving said first pivot portion of said first arm and a second cavity for rotatably receiving said second pivot portion of said second arm, said first retainer being disposed in said first cavity and said second retainer being disposed in said second cavity.

6. The handle assembly of claim 5, wherein said inner portion of said stationary bracket further includes a third cavity for receiving said flange portion of said first pivot portion of said first arm and a fourth cavity for receiving said flange portion of said second pivot portion of said second arm.

7. A lightweight handle for a container comprising:

a bracket having at least one axial cavity, said bracket being attachable to a container;

at least one stationary stop member connected with said container;

a handle comprising a hand grip and two arms extending from said hand grip, said arms further including pivot portions for pivotable engagement with said bracket, said arms further including stop members each having a contact surface matable with said at least one stationary stop member;

a spring support extending axially from one of said pivot portions of said arms, said spring support having a substantially square section disposed on a distal end thereof; and a coiled torsion spring disposed about said spring support having a first end and a second end, said first end being formed as a substantially square tang for mating engagement with an outer periphery of said substantially square section, and said second end being attached to said bracket.

8. A light weight handle for a container as claimed in claim 7 wherein said pivot portions are generally cylindrical extensions of said arms extending from each arm generally parallel to said hand grip and toward one another.

9. A light weight handle for a container as claimed in claim 7 wherein said at least one stationary stop member is a feature of the container.

10. A light weight handle for a container as claimed in claim 7 wherein said at least one stationary stop member is a separate structure mounted to said container.

11. A light weight handle for a container as claimed in claim 7 wherein said at least one stationary stop member is two stop members.

12. A light weight handle for a container as claimed in claim 11 wherein said members are separate structures mounted to said container.

13. A light weight handle for a container as claimed in claim 11 wherein said members are features of the container.

14. A lightweight handle in combination with a container comprising:

a container;

a mounting surface on said container, said surface being recessed to provide at leas t an upper edge that is raised relative to said mounting surface;

a handle including a bracket and a movable bail mounted on said container adjacent said upper edge of said mounting surface;

at least one stop surface on said movable bail, said stop surface being located to contact said container at a predetermined location to reduce stress in the handle;

a spring support extending from one end of said handle, said spring support having a substantially square section disposed on a distal end thereof; and a coiled torsion spring disposed about said spring support having a first end and a second end, said first end being formed as a substantially square tang for mating engagement with an outer periphery of said substantially square section, and said second end being attached to said bracket.

15. A light weight handle as claimed in claim 14 wherein said predetermined location is a protuberance at the upper periphery of the mounting surface.

16. A light weight handle as claimed in claim 14 wherein said at least one stop surface is two surfaces.

17. A light weight handle as claimed in claim 14 wherein said predetermined location is one which contacts said at least one stop surface at an angle of about 45° to the container mounting surface.

18. A light weight handle as claimed in claim 15 wherein said predetermined location is two locations, and said at least one stop surface is two stop surfaces on said rotatable handle, both stop surfaces being maintained at about 45° to the container mounting surfaces.

19. A light weight handle assembly adapted to be recessed within a recess in a container wall comprising:

a) a bracket attachable to a container wall;

b) a handle having a handgrip portion and two arms extending from said handgrip portion, said arms being engageable within said bracket on at least one pivot;

c) at least one moveable stop associated with said handle;

d) at least one stationary stop wherein said at least one stationary stop and said at least on moveable stop come into contact with one another at a plane passing through an axis of said at least one pivot and tangent to an upper edge of said recess;

e) a spring support extending axially from said at least one pivot, said spring support having a substantially square section disposed on a distal end thereof; and f) a coiled torsion spring disposed about said spring support having a first end and a second end, said first end being formed as a substantially square tang for mating engagement with an outer periphery of said substantially square section, and said second end being attached to said bracket.

20. A lightweight handle assembly adapted to be recessed in a recess in a container wall comprising:

a) a bracket attachable to a container wall;

b) at least one stationary stop associated with said container;

c) a handle having a handgrip portion and two arms extending therefrom said arms being pivotally attachable with said bracket;

d) at least one moveable stop associated with said handle, said at least one moveable stop contacting said at least one stationary stop in the outer plane of said container;

e) a spring support extending axially from one of said two arms, said spring support having a substantially square section disposed on a distal end thereof; and f) a coiled torsion spring disposed about said spring support having a first end and a second end, said first end being formed as a substantially square tang for mating engagement with an outer periphery of said substantially square section, and said second end being attached to said bracket.

21. A lightweight handle assembly adapted to be recessed into a recess in a container comprising:

a) a bracket attachable to a wall of said container in said recess;

b) at least one stationary stop associated with said container;

c) a handle having a handgrip and two arms extending therefrom said arms being pivotally attachable with said bracket and wherein a pivot is located adjacent said wall upon which said bracket is attached;

d) at least one moveable stop associated with said handle, adjacent an outer plane of said handle when mounted on said container, said plane being coplanar with an outer plane of said container, said at least one moveable stop contacting said at least one stationary stop in the outer plane of said container;

e) a spring support extending axially from one of said two arms said spring support having a substantially square section disposed on a distal end thereof; and f) a coiled torsion spring disposed about said spring support having a first end and a second end, said first end being formed as a substantially square tang for mating engagement with an outer periphery of said substantially square section, and said second end being attached to said bracket.

* * * * *